US009390718B2

(12) United States Patent
Hosoya et al.

(10) Patent No.: US 9,390,718 B2
(45) Date of Patent: Jul. 12, 2016

(54) AUDIO SIGNAL RESTORATION DEVICE AND AUDIO SIGNAL RESTORATION METHOD

(75) Inventors: Kosuke Hosoya, Tokyo (JP); Satoru Furuta, Tokyo (JP); Tadashi Yamaura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 163 days.

(21) Appl. No.: 14/237,623

(22) PCT Filed: Dec. 27, 2011

(86) PCT No.: PCT/JP2011/007311

§ 371 (c)(1),
(2), (4) Date: Feb. 7, 2014

(87) PCT Pub. No.: WO2013/098885

PCT Pub. Date: Jul. 4, 2013

(65) Prior Publication Data

US 2014/0207443 A1 Jul. 24, 2014

(51) Int. Cl.
*G10L 19/02* (2013.01)
*G10L 19/012* (2013.01)
(Continued)

(52) U.S. Cl.
CPC ..... *G10L 19/012* (2013.01); *G10L 21/0208* (2013.01); *G10L 21/0388* (2013.01)

(58) Field of Classification Search
CPC ..... G10L 19/012; G10L 21/0388
USPC ..... 704/503, 265, 263, 258, 226, 224, 214, 704/203
See application file for complete search history.

(56) References Cited

U.S. PATENT DOCUMENTS 9,245,538 B1 * 1/2016 Avendano ..... G10L 25/90
2004/0166820 A1 * 8/2004 Sluijter ..... G10L 21/038 455/221

(Continued)

FOREIGN PATENT DOCUMENTS

| | | |
|---|---|---|
| JP | 2000 206995 | 7/2000 |
| JP | 2010 20251 | 1/2010 |
| JP | 2010 515946 | 5/2010 |
| JP | 2011 75728 | 4/2011 |

OTHER PUBLICATIONS

Boll, S. F., "Supression of Acoustic Noise in Seech Using Spectral Subtraction", IEEE Transactions on Acoustics, Speech, and Signal Processing, vol. ASSP-27, No. 2, pp. 113-120, (Apr. 1979).

(Continued)

*Primary Examiner* — Marcellus Augustin
(74) *Attorney, Agent, or Firm* — Oblon, McClelland, Maier & Neustadt, L.L.P.

(57) ABSTRACT

A sound source generating unit 101 generates from a narrowband audio signal not passing through noise suppression a sound source signal including a fine structure of a band to be restored. On the other hand, a noise suppressing unit 102 performs noise suppression of the narrowband audio signal and a spectral envelope estimating unit 103 estimates an spectral envelope of the band to be restored. A signal synthesizing unit 104 generates a pseudo-audio signal by combining the sound source signal and the spectral envelope, and the band-pass filter unit 105 passes the pseudo-audio signal of the band to be restored, and the signal addition unit 106 generates a broadband audio restoration signal by adding the pseudo-audio signal of the band to be restored to the narrowband audio signal.

9 Claims, 7 Drawing Sheets

(51) Int. Cl.
*G10L 21/0388* (2013.01)
*G10L 21/0208* (2013.01)

(56) References Cited

U.S. PATENT DOCUMENTS

| | | | | |
|---|---|---|---|---|
| 2008/0172223 | A1 | 7/2008 | Oh et al. | |
| 2010/0223052 | A1* | 9/2010 | Nilsson | G10L 21/038 704/205 |
| 2011/0015923 | A1* | 1/2011 | Dai | G10L 19/012 704/226 |
| 2011/0075832 | A1 | 3/2011 | Tashiro | |
| 2013/0024191 | A1* | 1/2013 | Krutsch | G10L 21/038 704/205 |

OTHER PUBLICATIONS

Lim, J. S. et al., "Enhancement and Bandwidth Compression of Noisy Speech", Proceedings of the IEEE, vol. 67, No. 12, pp. 1586-1604, (Dec. 1979).

McAulay, R. J. et al., "Speech Enhancement Using a Soft-Decision Noise Suppression Filter", IEEE Transactions on Acoustics, Speech, and Signal Processing, vol. ASSP-28, No. 2, pp. 137-145, (Apr. 1980).

International Search Report Issued Mar. 27, 2012 in PCT/JP11/007311 Filed Dec. 27, 2011.

* cited by examiner

AUDIO SIGNAL RESTORATION DEVICE AND AUDIO SIGNAL RESTORATION METHOD

TECHNICAL FIELD

The present invention relates to an audio signal restoration device and audio signal restoration method that expand an audio signal, the frequency band of which is limited to a narrowband because of passing through a transmission line such as a telephone circuit, to a broadband audio signal, and that restore an audio signal in a band deteriorated or impaired because of noise suppression, audio compression and the like.

BACKGROUND ART

In an analog telephone system, the frequency band of speech transmitted through a telephone circuit is band limited to a narrow band such as 300-3400 Hz. Accordingly, the quality of sound of the conventional telephone circuit is not so good. In addition, in digital speech communication such as a mobile phone, since the bandwidth is limited as in the analog circuit because of the bit rate limiting, the quality of sound is not so good as well.

With respect to the problem, an audio signal restoration technique is known which generates or restores a broadband audio signal simulatively from a narrowband audio signal on a receiving side. The audio signal restoration technique, however, has been developed as a technique to be applied to audio devices or fixed telephones from the first, and supposes an environment that has no or little noise mixed into the narrowband audio signal to be restored.

On the other hand, as a simulative restoration technique of a broadband audio signal from a narrowband audio signal to be restored which has noise mixed, an audio band expansion device of Patent Document 1 is proposed, for example.

In the Patent Document 1, as preprocessing of the audio signal restoration, a component separation unit is introduced which separates the narrowband audio signal into a noise eliminated signal (audio component) and an extracted noise signal (noise component). The component separation unit comprises a noise eliminating unit, a differential processing unit, and a periodic component eliminating unit, and separates the narrowband audio signal into the audio component extracted by the noise eliminating unit and the noise component extracted by the differential processing unit and periodic component eliminating unit. Then, a post-stage of the component separation unit executes audio signal restoration for the individual components so that even if noise is mixed into the input narrowband audio signal, it can reduce unpleasant noise and improve intelligibility of the output broadband audio restoration signal.

PRIOR ART DOCUMENT

Patent Document

Patent Document 1: Japanese Patent Laid-Open No. 2011-75728.

DISCLOSURE OF THE INVENTION

Problems to be Solved by the Invention

The conventional techniques have the following problems.

As for the audio signal restoration technique disclosed in the Patent Document 1, when noise is mixed into the input narrowband audio signal at a low S/N (Signal-to-Noise ratio), the noise estimation of the noise eliminating unit does not work well, and the amount of noise is estimated excessively. Then, since it executes noise suppression in accordance with the amount of noise excessively estimated, it suppresses not only the noise component of the narrowband audio signal but also the audio component, thereby offering a problem of corrupting a harmonic structure of the audio component separated.

Furthermore, it has another problem in that when it generates a sound source signal including a fine structure of the expansion band by using the narrowband audio signal with its harmonic structure corrupted, it can result in a less intelligible audio signal instead. This is because since it generates the fine structure of the expansion band by using information about the harmonic structure of the narrowband audio signal, the generation of the sound source signal is easily influenced by the corruption of the harmonic structure.

The present invention is implemented to solve the foregoing problems. Therefore it is an object of the present invention to provide an audio signal restoration device and audio signal restoration method capable of generating a more intelligible audio restoration signal by preventing the corruption of the harmonic structure of the narrowband audio signal even if noise is mixed into the input narrowband audio signal at a low S/N.

Means for Solving the Problems

An audio signal restoration device in accordance with the present invention comprises: a sound source generating unit that generates from an audio signal of a first frequency band a sound source signal of a second frequency band including the first frequency band; a noise suppressing unit that suppresses a noise component included in the audio signal of the first frequency band; a spectral envelope estimating unit that estimates a spectral envelope of the second frequency band from the audio signal of the first frequency band passing through noise suppression by the noise suppressing unit; and a signal synthesizing unit that generates an audio signal of the second frequency band by combining the sound source signal of the second frequency band the sound source generating unit generates and the spectral envelope of the second frequency band the spectral envelope estimating unit estimates.

An audio signal restoration method in accordance with the present invention comprises: a sound source generating step that generates from an audio signal of a first frequency band a sound source signal of a second frequency band including the first frequency band; a noise suppressing step that suppresses a noise component included in the audio signal of the first frequency band; a spectral envelope estimating step that estimates a spectral envelope of the second frequency band from the audio signal of the first frequency band passing through noise suppression by the noise suppressing step; and a signal synthesizing step that generates an audio signal of the second frequency band by combining the sound source signal of the second frequency band the sound source generating step generates and the spectral envelope of the second frequency band the spectral envelope estimating step estimates.

Advantages of the Invention

According to the present invention, since it generates the sound source signal from the audio signal in the first frequency band which does not undergo the noise suppression processing, it can prevent the corruption of the harmonic structure of the audio signal. Accordingly, even when the noise is mixed at a low S/N, it can generate the sound source signal using information about the harmonic structure the audio signal originally has. As a result, it can generate a more intelligible audio restoration signal.

BEST MODE FOR CARRYING OUT THE INVENTION

The best mode for carrying out the invention will now be described with reference to the accompanying drawings to explain the present invention in more detail.

Embodiment 1

Figure 1:
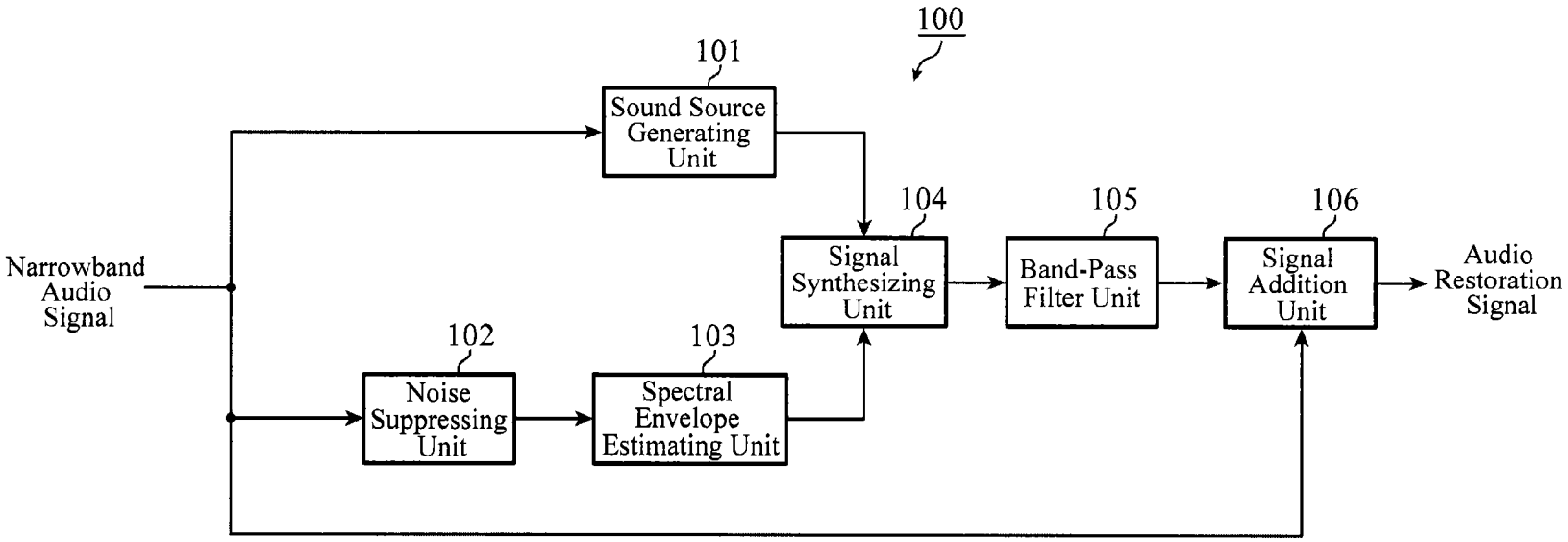
FIG. 1 is a block diagram showing a configuration of an audio signal restoration device of an embodiment 1 in accordance with the present invention.

FIG. 1 is a block diagram showing a configuration of the audio signal restoration device 100 of the present embodiment 1.

The audio signal restoration device 100 is a device that uses as its input an audio signal of a narrow band (referred to as the narrowband audio signal from now on) which passes through the band limiting of the audio signal of a broad band (referred to as the broadband audio signal from now on), and generates a broadband audio restoration signal by generating a signal of a limited band (referred to as the expansion band from now on) and by combining it with the narrowband audio signal.

In FIG. 1, a sound source generating unit 101 receives a narrowband audio signal as its input, generates a sound source signal including the fine structure of the expansion band, and supplies it to the signal synthesizing unit 104. A noise suppressing unit 102 receives the narrowband audio signal as its input, executes noise suppression, and supplies the noise suppressed narrowband audio signal to a spectral envelope estimating unit 103. The spectral envelope estimating unit 103 receives the noise suppressed narrowband audio signal as its input, estimates the spectral envelope of the expansion band, and supplies it to the signal synthesizing unit 104. The signal synthesizing unit 104 receives the sound source signal and the spectral envelope as its input, generates a pseudo-audio signal including the expansion band, and supplies it to a band-pass filter unit 105. The band-pass filter unit (first band-pass filter unit) 105 receives the pseudo-audio signal as its input, extracts frequency components other than the narrowband audio signal, and supplies them to a signal addition unit 106. The signal addition unit 106 receives the narrowband audio signal and the pseudo-audio signal band limited through the band-pass filter unit 105, generates a broadband audio restoration signal by adding the two signals, and outputs it to the outside of the device.

The present embodiment 1 removes the noise suppressing unit introduced before the sound source generating unit 101 to prevent the corruption of the harmonic structure of the narrowband audio signal. This enables the sound source generating unit 101 to generate the sound source signal including the fine structure of the expansion band from the harmonic structure the original audio signal has even when noise is mixed into the narrowband audio signal. Accordingly, even if noise is mixed into the input narrowband audio signal at a low S/N, it can generate a more intelligible broadband audio restoration signal.

Next, the operation of the audio signal restoration device 100 will be described.

First, audio and music sound or the like acquired with a microphone (not shown) or the like, is subjected to A/D (analog/digital) conversion, is then sampled at a prescribed sampling frequency (8000 Hz, for example), is divided into frame units (10 ms unit, for example), and is supplied to the audio signal restoration device 100 of the present embodiment 1 as a band limited narrowband audio signal (300-3400 Hz).

In addition, in the present description, it is assumed that the expansion band is 50-300 Hz and 3400-7000 Hz, and that the frequency band of a finally obtained broadband audio restoration signal is 50-7000 Hz.

Figure 2:
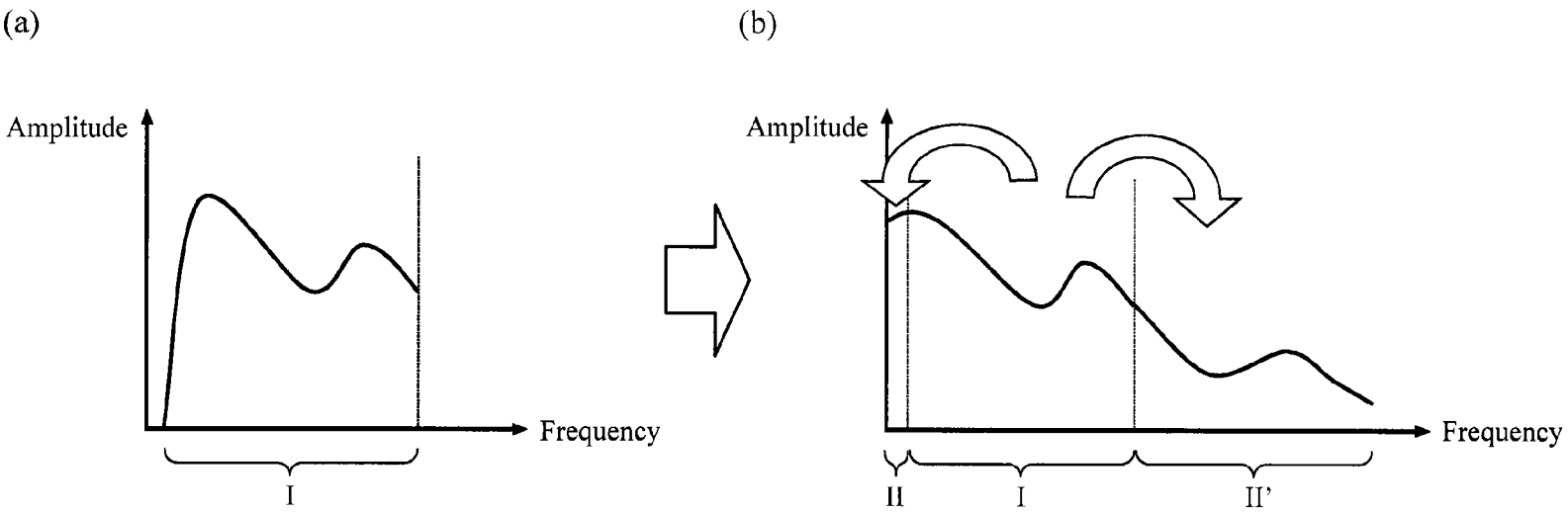
FIG. 2 is an image diagram of band extension processing the audio signal restoration device of the embodiment 1 executes.

FIG. 2 is an image diagram of the band extension processing the audio signal restoration device 100 of the present embodiment 1 executes: FIG. 2 (*a*) shows the input narrowband audio signal; and FIG. 2 (*b*) shows the broadband audio restoration signal. The audio signal restoration device 100 provides the narrowband audio signal limited to a band I with a low-frequency range II and a high-frequency range II' which are lacking originally but are estimated and added, and generates the broadband audio restoration signal expanded to the bands II, I and II'.

Incidentally, the band I corresponds to the first frequency band and the bands II, I and II' correspond to the second frequency band.

The sound source generating unit 101 generates the sound source signal including the fine structure of the expansion bands II and II' by carrying out the nonlinear processing of the narrowband audio signal. As the nonlinear processing to generate the harmonic structure of the expansion bands II and II', it is possible to use square processing, full-wave rectification, half-wave rectification or other processing.

The noise suppressing unit 102 performs noise suppression of the narrowband audio signal, and supplies the noise suppressed narrowband audio signal to the spectral envelope estimating unit 103.

Incidentally, as for the algorithm of the noise suppression processing the noise suppressing unit 102 employs, it can be a general algorithm. For example, it can use Spectral Subtraction (S. F. Boll, "Suppression of acoustic noise in speech using spectral subtraction", IEEE Trans. on Acoustics, Speech, and Signal Processing, vol. ASSP-27, No. 2, pp. 113-120, 1979); Wiener Filter (J. S. Lim, A. V. Oppenheim, "Enhancement and bandwidth compression of noisy speech", Proc. IEEE, vol. 67, No. 12, pp. 1586-1604, 1979); and Maximum Likelihood Estimate (R. J. McAulay, M. L. Malpass, "Speech enhancement using a soft-decision noise suppression filter", IEEE Trans. on Acoustics, Speech, and Signal Processing, vol. ASSP-28, No. 2, pp. 137-145, 1980).

The spectral envelope estimating unit 103 estimates the amplitude spectrum values in the expansion bands II and II' using only the information about the amplitude spectrum values of the noise suppressed narrowband audio signal as will be described later. As for the spectral envelope estimation method using the information about the amplitude spectrum values, if noise components are left in the narrowband audio signal, the amplitude spectrum values of the expansion bands to be estimated are estimated excessively, and the intelligibility of the final broadband audio restoration signal reduces. Thus, as the preprocessing of the spectral envelope estimating unit 103, the noise suppressing unit 102 executes the noise suppression.

In addition, in spite of the noise suppression, since the spectral envelope estimating unit 103 uses only the information about the amplitude spectrum values and does not use the information about the harmonic structure, it is little affected by the corruption of the harmonic structure of the audio components of the narrowband audio signal due to the noise suppression as compared with the sound source generating unit 101.

The spectral envelope estimating unit 103 calculates mean values of the amplitude spectrum of the narrowband audio signal passing through the noise suppression by the noise suppressing unit 102 (referred to as mean amplitude spectrum values from now on), estimates spectral envelopes in the expansion bands II and II' from the mean amplitude spectrum values using the learning model prepared in advance, and supplies them to the signal synthesizing unit 104.

Here, although a method of estimating the mean amplitude spectrum values in the expansion bands from the mean amplitude spectrum values of the narrowband audio signal will be described as an example, other methods can be employed as long as they can estimate a spectral envelope without using the information about the harmonic structure.

In addition, as for the learning model the spectral envelope estimating unit 103 uses for the estimation, it can be a model learned using a general algorithm such as linear regression, neural network and others.

In addition, the rough estimation using only the mean amplitude spectrum values can provide robust spectral envelope estimation for noise capable of preventing deterioration of the quality of sound of the broadband audio restoration signal even if noise is mixed into the input narrowband audio signal at a low S/N and some estimation errors occur in the mean amplitude spectrum values in the expansion bands.

Incidentally, the spectral envelope estimating unit 103 can obtain the mean amplitude spectrum values of the input narrowband audio signal and the mean amplitude spectrum values in the expansion bands to be estimated in several subbands into which the foregoing bands are divided. This offers an advantage of being able to estimate the spectral envelopes of the expansion bands more accurately.

On this occasion, the spectral envelope estimating unit 103 can estimate the amount of noise in each subband, and can obtain the mean amplitude spectrum values in the expansion bands using only subbands with a small estimated amount of noise. This offers an advantage of being able to reduce the excessive estimation of the mean amplitude spectrum values in the expansion bands due to the effect of mixing of noise into the input narrowband audio signal.

In addition, it is also possible to set a prescribed upper limit for the mean amplitude spectrum values in the expansion bands to be estimated. This offers an advantage of being able to prevent the mean amplitude spectrum values in the expansion bands from being estimated much greater than those of the ideal broadband audio signal due to the mixing of noise into the input narrowband audio signal. The term "ideal broadband audio signal" here refers to the audio signal before the band limiting.

The upper limit can be a fixed value or can be changed dynamically frame by frame in accordance with the mean amplitude spectrum values of the input narrowband audio signal.

In addition, since the spectral modes vary according to a phoneme, the upper limit can be switched in accordance with the phonological features. For example, since it is known that the amplitude spectrum values of a spectrum of an unvoiced fricative section increase as the frequency range becomes higher, the upper limit is increased in the unvoiced fricative section. This will be effective in obtaining a more intelligible broadband audio restoration signal.

Incidentally, although the present embodiment 1 is described using the amplitude spectrum values as an example of the scale of the estimation of the spectral envelope estimating unit 103, this is not essential. For example, a power spectrum can be used as the scale.

The signal synthesizing unit 104 receives as its input the sound source signal including the fine structure of the expansion bands II and II' generated by the sound source generating unit 101 and the spectral envelopes of the expansion bands II and II' estimated by the spectral envelope estimating unit 103, and generates the pseudo-audio signal of the bands II, I and II' by combining the sound source signal and the spectral envelopes.

The band-pass filter unit 105 receives as its input the pseudo-audio signal generated by the signal synthesizing unit 104, extracts only the frequency components other than the band I of the narrowband audio signal from the pseudo-audio signal, and supplies them to the signal addition unit 106 as a band limited pseudo-audio signal (bands II and II'). In the present embodiment 1, the low-frequency range components not higher than 300 Hz and the high-frequency range component not less than 3400 Hz are extracted.

Incidentally, the band-pass filter unit 105 corresponds to a first band-pass filter unit and the bands II and II' correspond to a third frequency band.

As the band-pass filter unit 105, an FIR (Finite Impulse Response) filter, an IIR (Infinite Impulse Response) filter or the like can be used for extracting the low-frequency range components and the high-frequency range components.

The signal addition unit 106 receives as its input the narrowband audio signal (band I) and the pseudo-audio signal (bands II and II') band limited by the band-pass filter unit 105, and adds the two signals, thereby generating the broadband audio restoration signal in the bands II, I and II'.

As described above, according to the embodiment 1, the audio signal restoration device 100 comprises the sound source generating unit 101 that generates the sound source signal in the bands II, I and II' from the narrowband audio signal limited to the band I; the noise suppressing unit 102 that suppresses the noise components in the narrowband audio signal; the spectral envelope estimating unit 103 that estimates the spectral envelopes in the bands II and II' from the narrowband audio signal noise suppressed by the noise suppressing unit 102; and the signal synthesizing unit 104 that generates the pseudo-audio signal in the bands II, I and II' by combining the sound source signal in the bands II, I and II' the sound source generating unit 101 generates and the spectral envelopes in the bands II and II' the spectral envelope estimating unit 103 estimates. Thus, the embodiment 1 can generate the sound source signal from the narrowband audio signal that does not undergo the noise suppression processing, thereby being able to prevent the corruption of the harmonic structure of the sound source signal. Accordingly, even if noise is mixed at a low S/N, it can generate the sound source signal using the information about the harmonic structure the narrowband audio signal originally has. As a result, it can restore a more intelligible broadband audio restoration signal.

In addition, according to the embodiment 1, the audio signal restoration device 100 comprises the band-pass filter unit 105 that extracts the pseudo-audio signal in the bands II and II' from the pseudo-audio signal in the bands II, I and II' the signal synthesizing unit 104 synthesizes; and the signal addition unit 106 that adds the pseudo-audio signal in the bands II and II' extracted through the band-pass filter unit 105 and the narrowband audio signal. Accordingly, using the pseudo-audio signal generated from the harmonic structure the narrowband audio signal originally has, the embodiment 1 can expand the band, thereby being able to restore a more intelligible broadband audio restoration signal.

In addition, according to the embodiment 1, the spectral envelope estimating unit 103 is configured in such a manner as to estimate as the spectral envelope the mean amplitude spectrum values in the bands II and II' from the mean amplitude spectrum values obtained from the narrowband audio signal noise suppressed by the noise suppressing unit 102. Accordingly, the embodiment 1 is little affected by the noise suppression because it does not use the information about the harmonic structure when estimating the spectral envelope, thereby being able to generate a more intelligible broadband audio restoration signal.

Incidentally, although the configuration of carrying out the band restoration of both the low-frequency range II and the high-frequency range II' is described in the embodiment 1, a configuration is also possible which executes the band restoration of only the low-frequency range II or the high-frequency range II' as needed.

Embodiment 2

Figure 3:
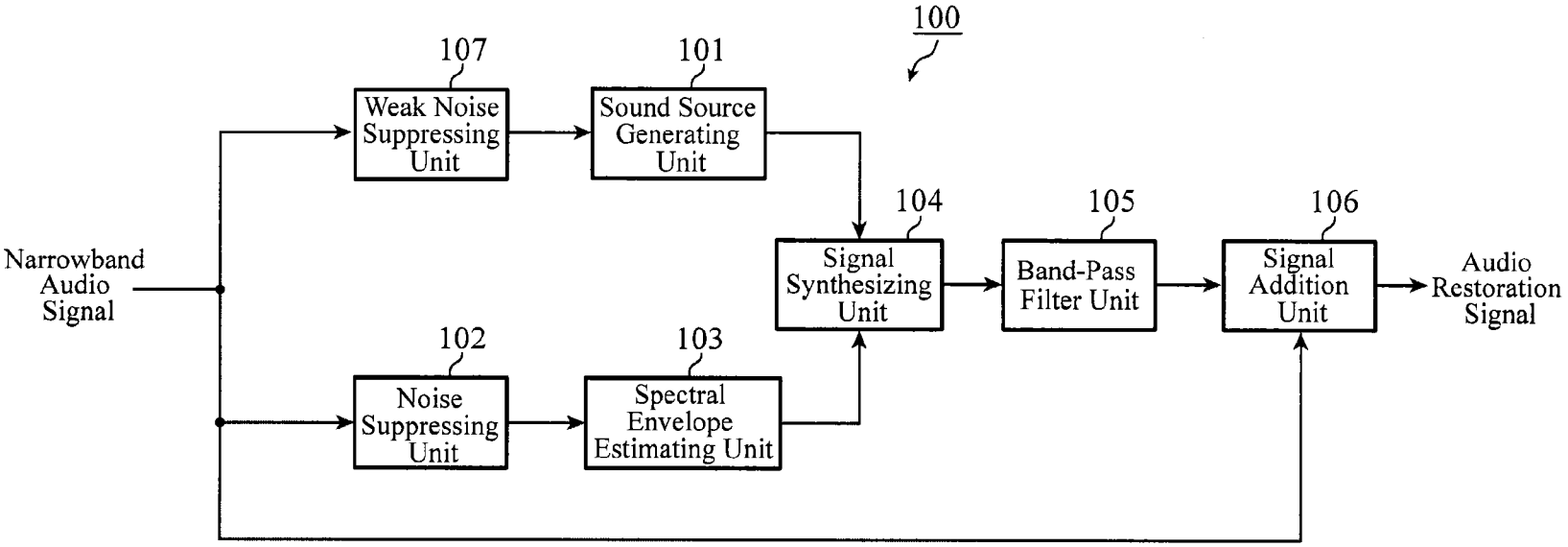
FIG. 3 is a block diagram showing a configuration of an audio signal restoration device of an embodiment 2 in accordance with the present invention.

FIG. 3 is a block diagram showing a configuration of an audio signal restoration device 100 of the present embodiment 2. In FIG. 3, the same or like components to those of FIG. 1 are designated by the same reference numerals, and their description will be omitted.

The audio signal restoration device 100 of the present embodiment 2 is a variation of the embodiment 1, which has a weak noise suppressing unit 107 introduced as preprocessing of the sound source generating unit 101.

As described before, the conventional audio signal restoration technique has a problem in that when noise is mixed into the input narrowband audio signal at a low S/N, the noise estimation does not work well, and the amount of noise is estimated excessively. In that case, since it executes noise suppression in accordance with the excessively estimated amount of noise, it suppresses not only the noise components of the narrowband audio signal but also the audio component, thereby sometimes corrupting the harmonic structure of the audio component of the narrowband audio signal. The corruption of the harmonic structure of the audio component of the input narrowband audio signal is particularly serious in the sound source signal generation.

Then, in the present embodiment 2, the weak noise suppressing unit 107 sets a prescribed upper limit for the noise suppression amount so as to prevent the harmonic structure of the audio component of the narrowband audio signal from being corrupted owing to the noise suppression, and executes noise suppression in accordance with the noise suppression amount not greater than the upper limit.

Incidentally, the upper limit of the noise suppression amount can be a fixed value, or can be altered dynamically frame by frame by detecting the maximum value of the amplitude of the input narrowband audio signal and by varying in accordance with the maximum value.

In addition, as for the algorithm the weak noise suppressing unit 107 uses, it can be the same algorithm as that of the noise suppressing unit 102 or can differ from that.

As described above, according to the embodiment 2, the audio signal restoration device 100 is configured in such a manner that it comprises the weak noise suppressing unit 107 that suppresses the noise component in the narrowband audio signal while limiting the noise suppression amount within the prescribed upper limit, and that the sound source generating unit 101 generates the sound source signal in the bands II, I and II' from the narrowband audio signal noise suppressed by the weak noise suppressing unit 107. Accordingly, as the preprocessing of the amplitude spectrum value estimation, the embodiment 2 can execute the noise suppression while reducing the influence of the corruption of the harmonic structure. Accordingly, even if noise is mixed into the input narrowband audio signal at a low S/N, it has an advantage of being able to generate a more intelligible broadband audio restoration signal.

Embodiment 3

Figure 4:
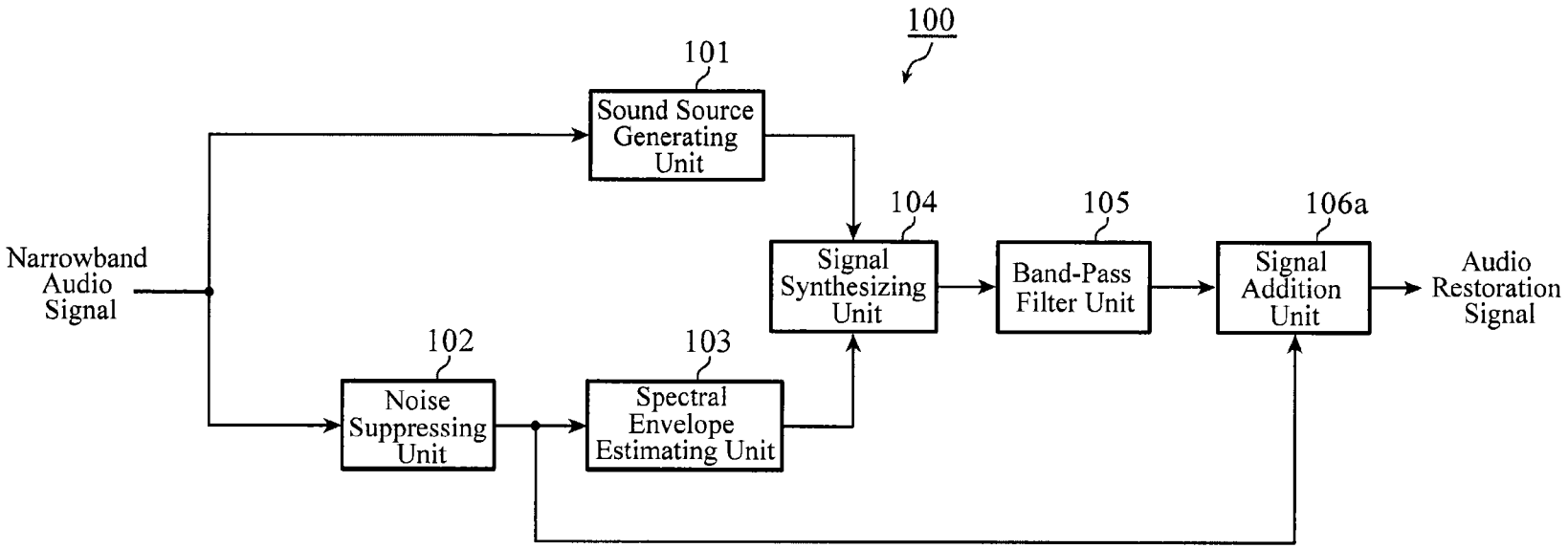
FIG. 4 is a block diagram showing a configuration of an audio signal restoration device of an embodiment 3 in accordance with the present invention.

FIG. 4 is a block diagram showing a configuration of an audio signal restoration device 100 of the present embodiment 3. In FIG. 4, the same or like components to those of FIG. 1 are designated by the same reference numerals, and their description will be omitted.

The audio signal restoration device 100 of the present embodiment 3, which is a variation of the embodiment 1, changes the input to the signal addition unit **106*a* from the narrowband audio signal to the narrowband audio signal noise suppressed by the noise suppressing unit 102**.

The signal addition unit **106*a* received as its input the narrowband audio signal noise suppressed by the noise suppressing unit 102 (for example, the band I shown in FIG. 2) and the pseudo-audio signal band limited by the band-pass filter unit 105 (for example, bands II and II' shown in FIG. 2**), and adds the two signals to generate the broadband audio restoration signal.

As described above, according to the embodiment 3, the signal addition unit **106*a* is configured in such a manner as to add the pseudo-audio signal in the bands II and II' extracted by the band-pass filter unit 105 and the narrowband audio signal noise suppressed by the noise suppressing unit 102**. Accordingly, the band I, which is a narrowband audio signal component of the broadband audio restoration signal finally output, is replaced by the noise suppressed signal. As a result, even if noise is mixed into the input narrowband audio signal at a low S/N, it offers an advantage of being able to generate the broadband audio restoration signal with intelligibility higher than the embodiment 1.

Embodiment 4

Figure 5:
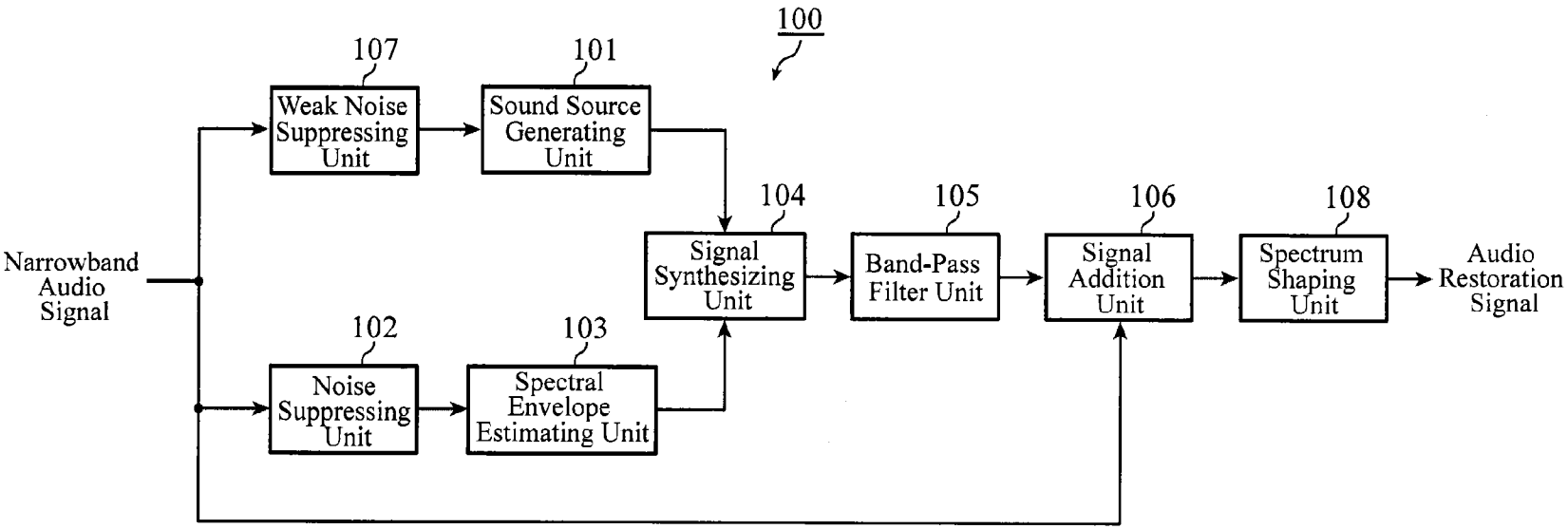
FIG. 5 is a block diagram showing a configuration of an audio signal restoration device of an embodiment 4 in accordance with the present invention.

FIG. 5 is a block diagram showing a configuration of the audio signal restoration device 100 of the present embodiment 4. In FIG. 5, the same or like components to those of FIG. 3 are designated by the same reference numerals, and their description will be omitted.

The audio signal restoration device 100 of the present embodiment 4, which is a variation of the embodiment 2, has a spectrum shaping unit 108 introduced as the postprocessing of the signal addition unit 106.

As compared with the ideal broadband audio signal, the broadband audio restoration signal generated by the audio signal restoration device 100 is apt to have a greater local maximum of the harmonic structure or on the contrary a smaller local minimum thereof. This is because the spectral envelope estimation has some estimation error. Then, as compared with the case of estimating only an audio signal, mixing of noise will decrease the estimation accuracy of the spectral envelope of the expansion band. Accordingly, the foregoing tendency is conspicuous when generating the broadband audio restoration signal by generating the expansion band from the noise mixed narrowband audio signal. Such difference from the ideal broadband audio signal is considered to be a factor of deteriorating the intelligibility.

Accordingly, the present embodiment 4 introduces the spectrum shaping unit 108 that shapes the corruption of the harmonic structure described above so as to make the harmonic structure more similar to the harmonic structure of the ideal broadband audio signal, thereby improving the quality of sound of the broadband audio restoration signal.

The spectrum shaping unit 108 receives as its input the broadband audio restoration signal generated by the signal addition unit 106, shapes the spectral envelope of the broadband audio restoration signal, and outputs it.

As concrete processing of the spectrum shaping, there are peak emphasis processing, dip emphasis processing, convolution processing of a filter and the like. However, as long as it is the processing that will make more similar to the ideal broadband audio signal, other processing can be employed.

As for the peak emphasis processing, for example, the spectrum shaping unit 108 obtains the mean value of the amplitude spectrum values of the expansion band in the broadband audio restoration signal, and if the difference between the mean value and the local maximum of the harmonic structure of the expansion band is less than a prescribed threshold, it executes the processing of increasing the amplitude spectrum value at the local maximum.

Incidentally, the threshold can be a fixed value or can be altered adaptively in accordance with the mean amplitude spectrum value of the input narrowband audio signal. In addition, the degree of emphasis of the amplitude spectrum value can be a fixed value or can be altered adaptively in accordance with the mean amplitude spectrum value of the input narrowband audio signal.

As for the dip emphasis processing, for example, the spectrum shaping unit 108 obtains the mean value of the amplitude spectrum values of the expansion band in the broadband audio restoration signal, and if the difference between the mean value and the local minimum of the harmonic structure of the expansion band is greater than a prescribed threshold, it executes the processing of reducing the amplitude spectrum value at the local minimum.

Incidentally, as in the peak emphasis processing, the threshold and the degree of emphasis can be a fixed value or can be altered adaptively in accordance with the mean amplitude spectrum value of the input narrowband audio signal.

As for the convolution processing of the filter, for example, a method is conceivable in which the spectrum shaping unit 108 extracts the fundamental frequency of the narrowband audio signal, and convolutes a filter that will emphasize its harmonics in accordance with the extracted fundamental frequency. Alternatively, instead of extracting the fundamental frequency, it is also possible to set filter coefficients in advance in accordance with the fundamental frequency range of general human voice (100-200 Hz).

As described above, according to the embodiment 4, the audio signal restoration device 100 is configured in such a manner as to comprise the spectrum shaping unit 108 that shapes the spectrum of the broadband audio restoration signal the signal addition unit 106 generates. Accordingly, the embodiment 4 has an advantage of being able to generate a more intelligible broadband audio restoration signal.

Incidentally, although in the foregoing embodiments 1-4, an example is described which employs a telephone audio signal as the narrowband audio signal, and generates the broadband audio restoration signal of 30-7000 Hz from the band limited audio signal of 300-3400 Hz, the frequency bands of the narrowband audio signal and broadband audio restoration signal are not limited to those values. For example, they are applicable to a wider band such as a broadband audio restoration signal of 25-14000 Hz.

Embodiment 5

As shown in the image diagram of FIG. 2, the foregoing embodiments 1-4 have a configuration that estimates the low-frequency range II and high-frequency range II' which do not exist originally, and provides them to the narrowband audio signal limited to the band I to generate a more intelligible broadband audio restoration signal with its bandwidth being extended to the bands II, I and II'.

In contrast with this, although the bandwidth of the input narrowband audio signal and that of the audio restoration signal are the same as those of the foregoing embodiments, the present embodiment 5 has a configuration that restores a signal component in a band missing from the band of the narrowband audio signal.

Figure 6:
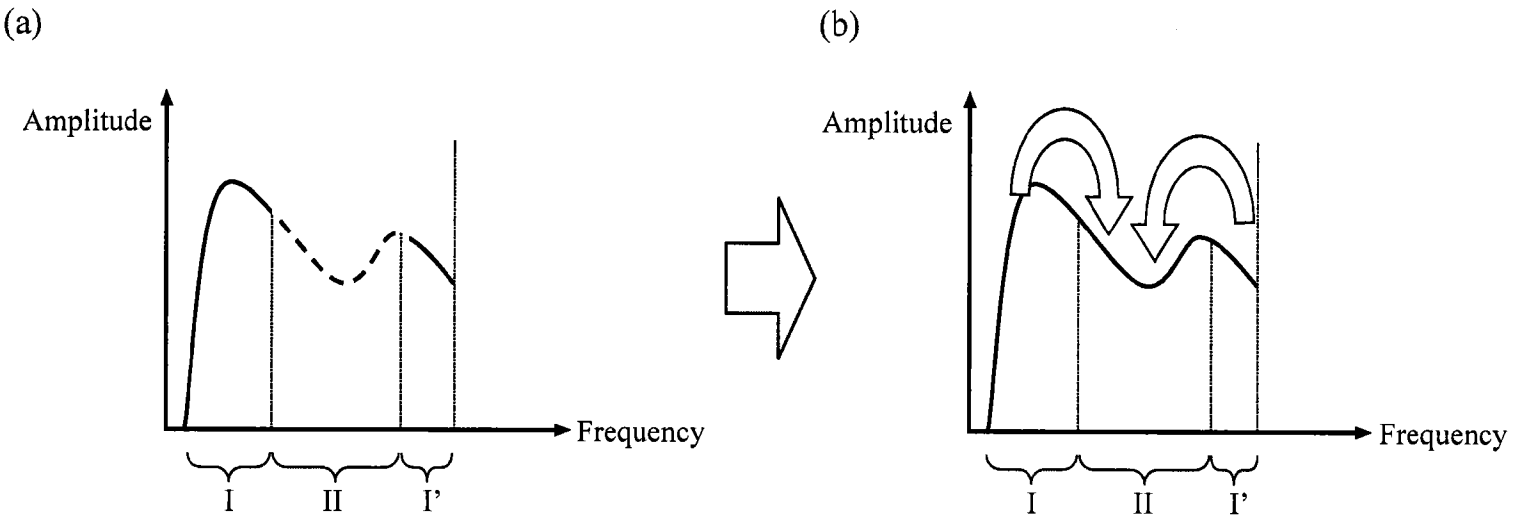
FIG. 6 is an image diagram of audio restoration processing the audio signal restoration device of an embodiment 5 in accordance with the present invention executes.

FIG. 6 is an image diagram of the audio restoration processing the audio signal restoration device 100 of the present embodiment 5 executes: FIG. 6 (*a*) shows an input narrowband audio signal; and FIG. 6 (*b*) shows an output audio restoration signal. The input narrowband audio signal has a deteriorated or missing audio signal of a band II among the bands I, II and I' because of the noise suppression processing and audio compression processing. The audio signal restoration device 100 estimates the deteriorated or missing band II, and provides it to the narrowband audio signal to generate the audio restoration signal with its band being restored to the bands I, II and I'.

Incidentally, the bands I, II and I' correspond to a first frequency band and second frequency band.

The audio signal restoration device 100 of the present embodiment 5 has the same configuration as the audio signal restoration device 100 of the embodiments 1-4 shown in FIG. 1-FIG. 5.

To eliminate the deteriorated band II from the narrowband audio signal, however, it is necessary for the audio signal restoration device of FIG. 1, FIG. 3 or FIG. 5 to comprise a band-pass filter unit (corresponding to a second band-pass filter unit) which passes the bands other than the band II and is incorporated between the input side of the narrowband audio signal and the signal addition unit 106. In addition, it is necessary for the audio signal restoration device of FIG. 4 to have a band-pass filter unit (corresponding to the second band-pass filter unit) which passes the bands other than the band II and is incorporated between the noise suppressing unit 102 and the signal addition unit 106*a*.

Incidentally, the bands I and I' extracted by the band-pass filter unit not shown correspond to a fourth frequency band.

As described above, according to the embodiment 5, the audio signal restoration device 100 is configured in such a manner that it comprises the band-pass filter unit 105 that extracts the pseudo-audio signal of the band II from the pseudo-audio signal of the bands I, II and I' synthesized by the signal synthesizing unit 104, and the band-pass filter unit not shown that extracts the narrowband audio signal of the bands I and I' from the narrowband audio signal of the bands I, II and I', and that the signal addition unit 106 adds the pseudo-audio signal of the band II extracted by the band-pass filter unit 105 and the narrowband audio signals of the bands I and I' extracted by the band-pass filter unit not shown. Accordingly, it is expected to restore the band II missing because of the noise suppression and the like, and to generate a more intelligible audio restoration signal.

Embodiment 6

Figure 7:
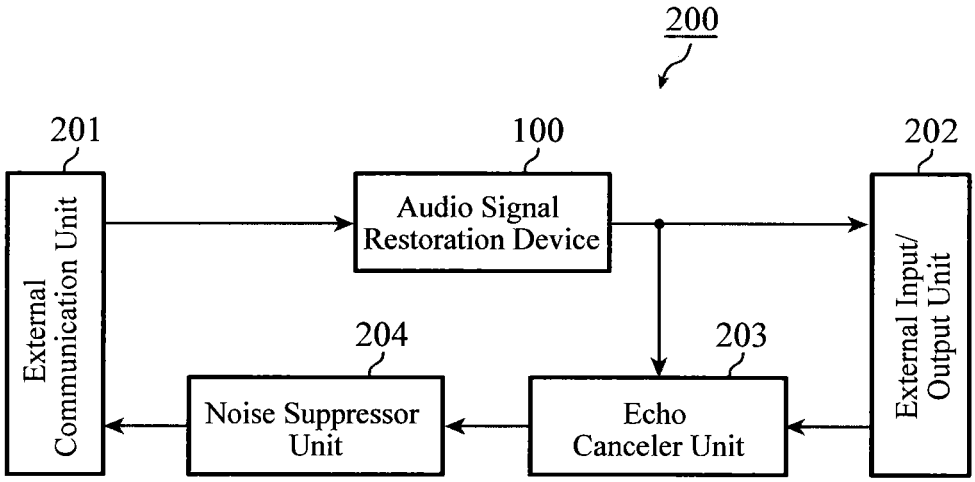
FIG. 7 is a block diagram showing a configuration of a hands-free telephone communication system using an audio signal restoration device of an embodiment 6 in accordance with the present invention.

FIG. 7 is a block diagram showing a configuration of a hands-free telephone communication system 200 of a car navigation device using an audio signal restoration device 100 of the present embodiment 6. As the audio signal restoration device 100, one of the audio signal restoration devices 100 of the embodiments 1-5 is employed.

An external communication unit 201 communicates with a mobile phone of a user in a vehicle using Bluetooth (registered trademark) or the like, and exchanges audio signals (speech received from the party on the other end and the user speech) with the mobile phone. The audio signal restoration device 100 receives as its input the audio signal of the party on the other end (that is, the narrowband audio signal) output from the external communication unit 201, executes the audio restoration described in the embodiments 1-5, and supplies to an external input/output unit 202. The external input/output unit 202 comprises a speaker and a microphone not shown, and functions as an interface with the user. Thus, it reproduces the audio signal (that is, the broadband audio signal) passing through the audio restoration by the restoration device 100, or picks up the speech of the user and outputs as an audio signal.

An echo canceler unit 203 receives as its input the broadband audio signal passing through the audio restoration by the audio signal restoration device 100 and the signal which is obtained by picking up the broadband audio signal reproduced through the speaker with the microphone of the external input/output unit 202, and suppresses an echo resulting from picking up the audio signal output from the speaker with the microphone. A noise suppressor unit 204 receives as its input the audio signal of the user the echo canceler unit 203 outputs, suppresses noise which is produced during driving and is included in the audio signal, and supplies the noise suppressed audio signal to the external communication unit 201.

As described above, according to the embodiment 6, incorporating the audio signal restoration device 100 into the hands-free telephone communication system 200 makes it possible to provide more intelligible received speech even if the party on the other end of the line is in a noisy environment.

Although the audio signal restoration device 100 is applied to the hands-free telephone communication system 200 of the car navigation apparatus in the embodiment 6, this is not essential. For example, it is applicable to a car navigation system, telephone communication system such as a mobile phone, a hands-free telephone system, videoconference system, monitoring system, and the like into which speech communication, audio storage and voice recognition system are incorporated, and offers an advantage of being able to improve the quality of sound and the voice recognition rate of these systems.

Incidentally, it is to be understood that a free combination of the individual embodiments, variations of any components of the individual embodiments or removal of any components of the individual embodiments are possible within the scope of the present invention.

INDUSTRIAL APPLICABILITY

As described above, an audio signal restoration device in accordance with the present invention enables more intelligible audio restoration in spite of the noise mixed at a low S/N. Accordingly, it is suitable for an application to an onboard hands-free telephone system and the like.

DESCRIPTION OF REFERENCE SYMBOLS

100 audio signal restoration device; 101 sound source generating unit; 102 noise suppressing unit; 103 spectral envelope estimating unit; 104 signal synthesizing unit; 105 band-pass filter unit (first band-pass filter unit); 106, 106*a* signal addition unit; 107 weak noise suppressing unit; 108 spectrum shaping unit; 200 hands-free telephone communication system; 201 external communication unit; 202 external input/output unit; 203 echo canceler unit; 204 noise suppressor unit.

What is claimed is:

1. An audio signal restoration device comprising:

a sound generator that receives an audio signal of a first frequency band and generates, from the received audio signal of the first frequency, a sound source signal of a second frequency band including the first frequency band and being wider than the first frequency band;

a noise suppressor that receives the audio signal of the first frequency band and generates a noise suppressed audio signal in which a noise component included in the audio signal of the first frequency band is suppressed;

a spectral envelope estimator that estimates a spectral envelope of the second frequency band from the noise suppressed audio signal generated by the noise suppressor; and a signal synthesizer that generates an audio signal of the second frequency band by combining the sound source signal of the second frequency band the sound generator generates and the spectral envelope of the second frequency band the spectral envelope estimator estimates.

2. The audio signal restoration device according to claim 1, further comprising:

a weak noise suppressor that suppresses the noise component included in the audio signal of the first frequency band while limiting the noise suppression amount within a prescribed upper limit, wherein the sound generator generates the sound source signal of the second frequency band from the audio signal of the first frequency band passing through the noise suppression by the weak noise suppressor.

3. The audio signal restoration device according to claim 1, wherein the spectral envelope estimator calculates mean values of amplitude spectra from the audio signal of the first frequency band passing through the noise suppression by the noise suppressor, and estimates, based on the calculated means values, the spectral envelope of the second frequency band.

4. The audio signal restoration device according to claim 1, further comprising:

a first band-pass filter that extracts an audio signal of a third frequency band from the audio signal of the second frequency band passing through synthesis of the signal synthesizer, the third frequency band being different from the first frequency band; and a signal adder that adds the audio signal of the third frequency band extracted by the first band-pass filter and the audio signal of the first frequency band.

5. The audio signal restoration device according to claim 4, further comprising:

a spectrum shaper that shapes the spectrum of the audio signal the signal adder generates.

6. The audio signal restoration device according to claim 1, wherein a first band-pass filter that extracts an audio signal of a third frequency band from the audio signal of the second frequency band passing through synthesis of the signal synthesizer, the third frequency band being different from the first frequency band; and a signal adder that adds the audio signal of the third frequency band extracted by the first band-pass filter and the audio signal of the first frequency band passing through the noise suppression by the noise suppressor.

7. The audio signal restoration device according to claim 1, wherein the spectral envelope estimator estimates the spectral envelope of the second frequency band based only on the noise suppressed audio signal generated by the noise suppressor.

8. An audio signal restoration method comprising:

receiving an audio signal of a first frequency band;

generating, from the received audio signal of the first frequency band, a sound source signal of a second frequency band including the first frequency band and being wider than the first frequency band;

suppressing a noise component included in the audio signal of the first frequency band and generating a noise suppressed audio signal;

estimating a spectral envelope of the second frequency band from the noise suppressed audio signal; and synthesizing an audio signal of the second frequency band by combining the sound source signal of the second frequency band generated by the generating and the estimated spectral envelope of the second frequency band estimated by the estimating.

9. The audio signal restoration method according to claim 8, further comprising:

estimating the spectral envelope of the second frequency band based only on the noise suppressed audio signal.

* * * * *